United States Patent [19]

Lerner et al.

[11] Patent Number: 4,926,048

[45] Date of Patent: May 15, 1990

[54] PROCESS OF PERFORMING WORK ON A CONTINUOUS WEB

[75] Inventors: Hershey Lerner, Hudson; Bernard Lerner, Peninsula, both of Ohio

[73] Assignee: Automated Packaging Systems, Inc., Twinsburg, Ohio

[21] Appl. No.: 759,503

[22] Filed: Jul. 26, 1985

Related U.S. Application Data

[60] Continuation of Ser. No. 378,079, May 14, 1982, abandoned, which is a division of Ser. No. 166,500, Jul. 7, 1980, abandoned.

[51] Int. Cl.[5] ..... G01N 21/86

[52] U.S. Cl. ..... 250/548; 226/2; 250/461.1

[58] Field of Search ..... 250/548, 561, 571, 341, 250/359.1, 365, 372; 226/2, 3, 27, 33, 45; 356/429

[56] References Cited

U.S. PATENT DOCUMENTS

| | | | |
|---|---|---|---|
| 2,400,447 | 5/1946 | Wells et al. . | |
| 2,929,931 | 3/1960 | Richter et al. . | |
| 2,938,292 | 5/1960 | Jaskowsky et al. . | |
| 3,105,908 | 10/1963 | Burkhardt et al. | 250/372 |
| 3,162,642 | 12/1964 | McCafferty . | |
| 3,204,842 | 9/1965 | Reimann . | |
| 3,237,973 | 3/1966 | Rumberger . | |
| 3,254,828 | 6/1966 | Lerner . | |
| 3,465,317 | 9/1969 | Rabinow . | |
| 3,492,478 | 1/1970 | Smith . | |
| 3,525,872 | 8/1970 | Schneider . | |
| 3,566,120 | 2/1971 | Lane, Jr. . | |
| 3,599,389 | 8/1971 | Hartman | 250/365 |
| 3,614,430 | 10/1971 | Berler . | |
| 3,641,733 | 2/1972 | Lerner . | |
| 3,671,451 | 6/1972 | Butterfield . | |
| 3,673,418 | 6/1972 | Wiig . | |
| 3,701,464 | 10/1972 | Crum . | |
| 3,760,161 | 9/1973 | Lohne et al. . | |
| 3,783,293 | 1/1974 | Gold et al. . | |
| 3,891,324 | 6/1975 | Davies | 250/561 X |
| 3,960,755 | 6/1976 | Beachem et al. . | |
| 3,968,350 | 7/1976 | Watson . | |
| 4,006,158 | 2/1977 | Fleck et al. . | |
| 4,009,551 | 3/1977 | Greenawalt et al. . | |
| 4,015,131 | 3/1977 | McDonough et al. . | |
| 4,022,709 | 5/1977 | Ferro et al. . | |
| 4,146,792 | 3/1979 | Stenzel et al. | 250/461.1 |

FOREIGN PATENT DOCUMENTS

| | | |
|---|---|---|
| 1939862 | 2/1971 | Fed. Rep. of Germany . |
| 2055371 | 5/1972 | Fed. Rep. of Germany . |

OTHER PUBLICATIONS

Sandoz Technical Bulletin; 1-C-2009 No. 2; Sandoz TH-40; pp. 1-3.

Mobay Technical Data; CL Solution; T.D.S. #1126.

Eastman Laser Products; JJ-169; 1977.

*Primary Examiner*—Edward P. Westin

*Attorney, Agent, or Firm*—Watts, Hoffmann, Fisher & Heinke Co.

[57] ABSTRACT

A web structure with electromagnetic radiation shifting indicia is disclosed. The indicia provide signals used in controlling various processes to be performed on the web as well as for controlling movement of the web. The preferred indicia are normally essentially invisible so that the physical appearance of the web is not effected. The indicia emit wave-shifted electromagnetic radiation in response to incident radiation of a given range to provide a means for determining the positioning of the web during movement as the process are performed. Process and apparatus for making and using such webs are also disclosed.

15 Claims, 2 Drawing Sheets

PROCESS OF PERFORMING WORK ON A CONTINUOUS WEB

This application is a continuation, of application Ser. No. 378,079, filed 5/14/1982 now abandoned. Which is a division of application Ser. No. 166,500 filed Jul. 7, 1980 now abandoned.

BACKGROUND OF THE INVENTION

1. Field of the Invention

This invention relates generally to the encoding of control information to a substantially continuous web of materials and manufacturing methods and apparatus utilizing such encoded webs. More particularly, the invention relates to a system which is especially adapted for use with webs for use in packaging and other applications.

2. Prior Art

Continuous plastic webs are manufactured for many purposes. As an example, chains of interconnected open bags such as those described and claimed in U.S. Pat. No. 3,254,828 to Hershey Lerner have been sold successfully under the trademark AUTOBAG. As another example, plastic mailing envelopes made from webs such as those disclosed in U.S. Pat. No. 3,641,733 to Hershey Lerner have been sold successfully under the trademark ZIP-VELOPE. In the manufacture of both the AUTOBAG and ZIP-VELOPE products, a web of plastic is first printed to provide identifying information and an attractive appearance. In subsequent manufacturing operations transverse seals are formed between two layers of the web. In the case of commercially produced AUTOBAG products, spaced transverse perforations are formed to provide lines of weakness for separation of the bags from the web.

Chains of interconnected bottle labels have also been produced in quantity. A label chain is in the form of a plastic tube which is perforated between each adjacent pair of labels to allow each label to be separated from the chain and placed around a blow-molded plastic, or similar, bottle.

In the manufacture of webs of material such as chains of bags or labels and strips of envelopes, it is important that manufacturing operations be accurately located along the web. As an example, the transverse seals obviously should be between adjacent bags or envelopes and not in central portions of them. Accordingly, it is important to accurately register the web with work stations on the machine performing operations on the web.

While there is reasonable latitude or tolerance in the location of any given operation on a web, there is a cumulative error problem which must be considered. For example, if each seal in an AUTOBAG web is mislocated by 0.001 of an inch so that each bag being formed is longer than it should be by that amount, and this error is allowed to repeat each time a bag is formed without error corrections, by the time the 1000th bag is formed the seal will be misregistered by one inch. Obviously, if one is transforming a printed web into a chain of bags, a strip of envelopes, or a string of labels such cumulative error cannot be tolerated.

The cumulative error problem is exacerbated when the web is plastic because plastics tend to stretch. Since it is virtually impossible to maintain constant web tension during printing and other manufacturing operations, stretching not only occurs but it occurs unevenly.

Because of the cumulative error problem, it is customary to repeatedly register the web with stations where manufacturing operations are to be performed. One known technique is to provide clear spaces in a web between the repetitive printed indicia which spaces function as "windows". A registration mark of some type is imprinted in the window. An optical detector is positioned to cyclically view the web. If the equipment is adjusted and functioning properly, each viewing of a cycle is concurrent with the passage of one of the windows past the detector. The detector senses the registration mark and causes the manufacturing operation to occur at a time coordinated with this sensing.

When printed decorative and informative indicia on the web is passing the detector, the detector is "blinded" so that it will not see and be confused by the imprinted indicia. Expressed another way, a detector should be turned off as decorative and informative indicia passes it and turned on when the detector is registered with a window.

A major problem with a cyclical detector which is "blinded" in each cycle is that if the web is out of registration so that the detector is operative when the decorative and informative indicia are under the detector, the detector emits erroneous signals and the machine will produce scrap. Thus, machine set-up, and the restoration of appropriate registration if the machine gets out of synchronism, is time-consuming and difficult.

The effectiveness of traditional registration marks for controlling operations even on essentially a clear web; that is a web which is not printed except for the visible "eye" marks, is also limited in respect to accuracy of detection. The accurate detection of such registration marks is dependent on either the largeness of the mark or, in the case of a small mark, the accuracy with which the detector is registered upon the fluctuating paths in which the marks travel. The accurate detection of traditional eye marks affixed to a plastic or other flexible, strechable, elastic web requires either; (a) a large eye mark to insure the passage of at least some portion of each mark underneath a stationary detector or, (b) in the case of small eye marks, a sophisticated detector tracking apparatus to insure the consistent registration of the detector upon the fluctuating paths of the moving marks.

Another known approach to maintaining appropriate registration between a web and various work stations is to provide a marginal registration strip with printed or other registration markings. While such an approach can simplify machine set up and registration, as compared with the cyclically blinded detector approach, the strip is trimed off and becomes scrap so this process is wasteful.

A variation in the technique for controlling the web movement with a removable strip employs gaps or holes positioned along the strip as position indicators for the web. The presence of the gap is detected by a spark-gap detector which completes a circuit by causing a spark to traverse the gap. In this way the presence or absence of gaps or holes along the web is indicated to control circuitry which in turn is used for maneuvering the web.

The spark-gap system for web control also has deficiencies. In order to complete a circuit with the use of a spark, it is necessary that a relatively high voltage be maintained between two portions of the spark-gap detector. In some environments, this can be very undesirable. For example, moisture can cause either a malfunction of the spark-gap detector or can provide a path of low electrical resistance which results in a false signal.

A second problem encountered with spark-gap detectors is that the detector cannot tell the difference between intentionally and unintentionally formed gaps or holes. If the control circuitry is activated by the presence of a rip in the registration strip of the web, control functions will be unsynchronized and web material will be wasted.

It has been suggested that magnetization of an area directly on the web with a decorative coating printed over the magnetized area can be used to provide a non-visible control function to the moving web. Magnetized areas are susceptible to detection by various known techniques and have been proposed for providing control coordination. A magnetized area, however, can be affected by its environment in an adverse manner. Electric and magnetic fields in the area of the moving web could create a condition where the detector would not detect the magnetized area and controlled coordination of movement would be lost. Further, if the magnetized area is placed directly upon the web it is virtually impossible, if not totally so, to hide the magnetized area with a printing overlay and with clear webs the area will be visible from the other side of the web. Thus, a magnetized area detracts from an intended and desired attractive appearance.

Another problem with prior web registration techniques has been that it has been usually necessary to provide some different form of web registration system when the web is used than the system employed in manufacturing the web. For example, if a removable registration strip was employed, that strip is not present when the user is labeling vessels or unloading and sealing bags or envelopes. In commercial machines for loading and sealing AUTOBAG products, spark gap detection has been employed. This has to some extent limited the application of such machines because obviously they cannot be used in explosive or very wet environments. Further, spark-gap detection can present service and other problems.

With the system described and claimed in the previously referenced envelope machine patent for unloading and sealing envelopes, each envelope is mechanically registered at the load station. While the machine and the system described have enjoyed good commercial success, greater productive capacity than can be achieved with that mechanical registration is desired.

There have been proposals to use visible light detectors in conjunction with materials which absorb ultraviolet light and emit visible light, for registration of work operations. However, until now, there have been no proposals which suggest the use of a wave shift sensitive detector in conjunction with electromagnetic wave shifting control indicia which emit either visible or invisible electromagnetic radiation for registration of work operations. Neither has anyone suggested the use of non visible electromagnetic wave shifting indicia in a repetitive pattern for control of repetitive work operations on a web.

Perhaps more importantly no one has suggested a web control which both permits complete freedom of choice in web decoration, lack of decoration, and/or the application of informative printing which does not suffer any of the described short comings of "blinded" detectors, hole or gap detection, or a wasted control strip. Thus, there have been no successful proposals for flexible web feed control which are universally useful both in web manufacture and use because all such proposals have had shortcomings such as adversely affecting the appearance of the web. Moreover, even if feasible, little if any use has been made of the same registration techniques for both manufacture and use of a tape or other web, at least with plastic bags, labels and envelopes.

SUMMARY OF THE INVENTION

The present invention overcomes difficulties encountered with prior art web control techniques by treating the web to provide spaced control signal forming or locating portions with invisible components for signal emission as an integral part of the web. These control signal markings or patterns are applied to the web and waste is eliminated because the whole web can be utilized in the final product. Since the control signals preferred are non-visible to the human eye the physical appearance of the web or product is in no way limited to the configuration or appearance of decorative and/or informative information applied to the web. The non-visible markings which are preferably transparent can be applied ay any portion of the web without regard to the physical appearance of the design on the web.

The locating portions respond to energy of predetermined characteristics directed to the web in a manner different than the response of other portions. In a preferred embodiment of the invention a web of material has an transparent pattern of material which emits wavelength shifted radiation in response to relatively high intensity electromagnetic radiation of an appropriate range of the spectrum. When the electromagnetic radiation of the appropriate wavelength range of the spectrum is shone on the web, the wavelength shifting causes a shift in wavelength and it emits relatively high intensity electromagnetic radiation which is in a different spectrum range.

A major advantage of electromagnetic wavelength shifting markings which are not visible to the human eye but produce wavelength shifted radiation in response to incident electromagnetic radiation is that it is possible to use a detector system which responds to the wavelength shifted radiation and not to ambient or reflected radiation. Thus, such a detector is not affected by reflections from the web or decorative and informative printing on the web so the entire surface of the web can be clear or printed and no timer strip or "window" is required.

A major reason the detector is unaffected by the reflections is that in a typical modern industrial environment low intensity lighting is provided. Any given type of light used in an industrial environment provides radiation of relatively low intensities which are readily distinguishable from the high intensity emission of the indicia even when reflections and emissions are of the same or similar wavelengths. Electromagnetic wave shifting material used in the control markings or indicia of this invention are selected from those which emit electromagnetic energy in relatively high intensities in response to stimulation by relatively high intensity radiation. The wave shifted radiation is significantly different from reflected radiation in the sense that the intensity is sufficiently different to enable ready detection.

As an example Kodak I.R. 125, a laser dye, emits electromagnetic radiation of about 9400 angstroms when exposed to incident radiation of about 7950 angstroms. While 9400 angstrom electromagnetic radiation is present in the illumination from typical industrial lighting, the web nonetheless can be decorated in any manner desired and reflections from the web which may include 9400 angstrom radiation will not cause false detector signals. Accordingly a detector sensitive to high intensity 9400 angstrom electromagnetic radiation is able to sense the presence of the indicia while continuously viewing the web without danger of emitting false signals.

The pattern of wave shifting material can either be intermittent or continuous and is arranged to contain information which is used in controlling functions performed on the web. The information is used in conjunction with other control devices which are activated by signals from the web each of which indicates a given control portion is at a predetermined location along a path of web travel.

A control station for detection of signals from the web includes a source of high intensity, indicia stimulating electromagnetic radiation which causes the web markings to emit wave shifted radiation and a detecting system which detects the wavelength shifted radiation and converts the electromagnetic radiation from that material into electrical signals. The detection system preferably includes a filtration system to exclude reflected electromagnetic radiation of wavelengths other than the wavelength band of the radiation emitted by the markings so that, among other things, reflections from the high intensity source are filtered out.

A preferred detection system is responsive to an essentially non-visible pattern in the form of markings which emit wavelength shifted electromagnetic radiation. This detection system includes a filter which transmits indicia emitted wave shifted radiation in a range of the spectrum to a detector but transmits essentially no reflected radiation of certain other wavelength ranges.

One advantage this system has over prior art control systems is the utilization of a pattern which can be applied directly to the web and which contains information useful in controlling web movements. Since the pattern of information normally is invisible to the eye the information containing material can be used in conjunction with designs or logos of any size, shape and nature without disrupting their appearance.

Again, the pattern of information contained within the wavelength shifting material may be continuous or intermittent. For some applications a repetitive, spaced strips of wave shifting material will be adequate for producing control information. In other applications it may be desirable to apply a continuous pattern of material to the web which pattern contains much more information than the spaced strips could contain. It is therefore an advantage to the system that the markings are invisible to the eye and allow great flexibility in the manner and presentation of the information on the web. Depending upon the functions to be controlled, the pattern of information containing material placed on the web may be either complex or simple.

The invention has additional utility as a means of quality control in packaging. A specific control mark can be applied to both a product and to a package for that product. Only when both product and package are sensed at an appropriate work station is the packaging step performed.

In addition to controlling manufacturing processes the wavelength shifting marks can be used for identification purposes. When applied to a product the marks can uniquely identify the product and help avoid mistaken and/or intentional substitution of an inferior or unsuitable product. In order to decrease the chance of the pattern being counterfeited, it is desirable both that the non-visible mark pattern be complex and that the mark pattern emit non-visible electromagnetic radiation.

From the above it is apparent that the present invention includes a number of advantageous characteristics for enhancing the efficiency and reliability of web control. No waste of a side or edge strip of tear-off material limits the efficiency of the preset system. Any design or appearance of the web is unaffected by the application of an invisible control signal to the web itself.

Utilization of an invisible control signal allows for a standardized design of information containing material regardless of the physical appearance of the web. Thus, the control signal design need not be changed when webs of differing physical appearance are substituted and since a standardized control can be used, the web control system need not be modified for every change of web design. Moreover, the application of an invisible web control to the web allows registration of the web during manufacture and during use with comparable systems using the same invisible control signal markings.

From the above, it is clear that one object of the present invention is to provide a simple yet efficient means for applying and utilizing invisible control signals on a web. These signals do not disrupt the pattern of the web yet emit wave shifted radiation in the presence of incident electromagnetic radiation in a particular portion of the spectrum to produce outputs which can be readily detected at a control station.

Other objects and features of the present invention will become better understood when considered in conjunction with the drawings and detailed description of a preferred embodiment which follows.

BRIEF DESCRIPTION OF THE DRAWINGS

FIG. 1 diagrammatically shows a system for making a chain of bags or the like;

PREFERRED EMBODIMENT OF THE INVENTION

Figure 1:
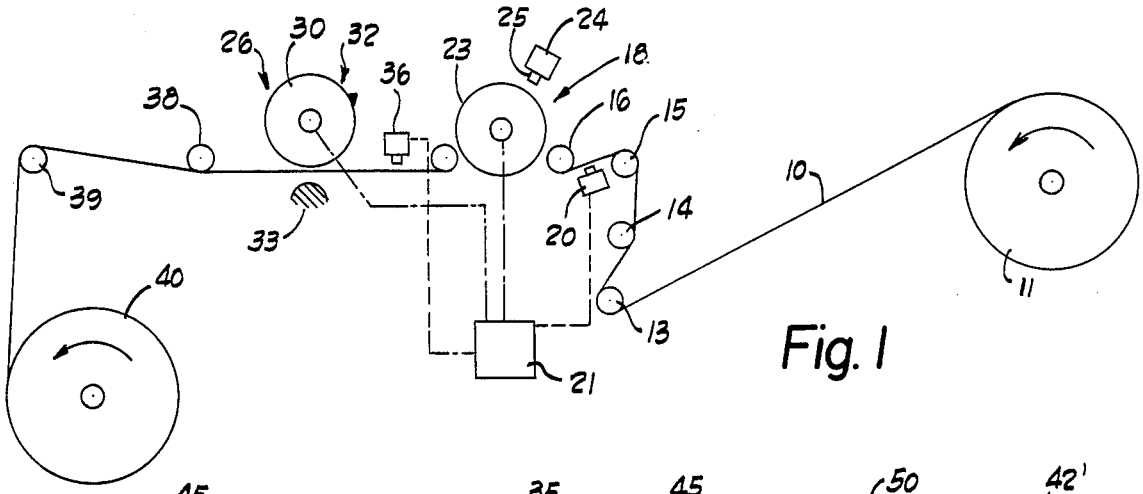

Referring to FIG. 1, a bag making operation is shown diagrammatically. In that operation a tubular printed web 10 is fed from a supply roll 11. The web 10 passes over tensioning rolls 13–16 and thence to a sealer station 18. An indicia responsive seal control detector is illustrated at 20. The machine, other than the detector and a control mechanism 21 which responds to its signals is of known construction and therefore not shown other than diagrammatically.

To simplify the disclosure, the printing of the web 10 has not been shown. This printing can be accomplished conventionally except for the imprinting of the novel indicia of this invention. Since the preferred indicia on a multi-colored web will be superimposed over other printing in many instances, the other printing may be applied first and then the indicia registered relative to that other printing by conventional techniques. In that event, all subsequent printing operation are then desirably controlled by detection and control corresponding to that used in the illustrated bag manufacturing operations.

Preferably, especially where precise registration is required, the first printing operation will imprint printing machine control indicia which are used to control subsequent printing. If these indicia are overprinted by such subsequent printing, further indicia are applied, when the preferred material is used, so that the finished product will have use control indicia on an outer surface of the web.

At the seal station 18, transverse seals are formed at regularly spaced intervals to delineate the ends of the interconnected bags. The sealer 18 includes a relatively soft roll 23 about which the web is tightly wrapped. The sealer 18 also includes a shuttle 24 having a heated resistive element 25 extending essentially from one side of the roll 23 to the other. When the heated element 25 is brought into contact with the web 10 to press the web against the roll 23 a transverse heat seal 26 (FIG. 2) is formed. The timing of the engagement of the element 25 with the strip is chosen so that proper end seal spacings will be provided. This is controlled by the detector and control 20, 21 as will be described.

Figure 2:
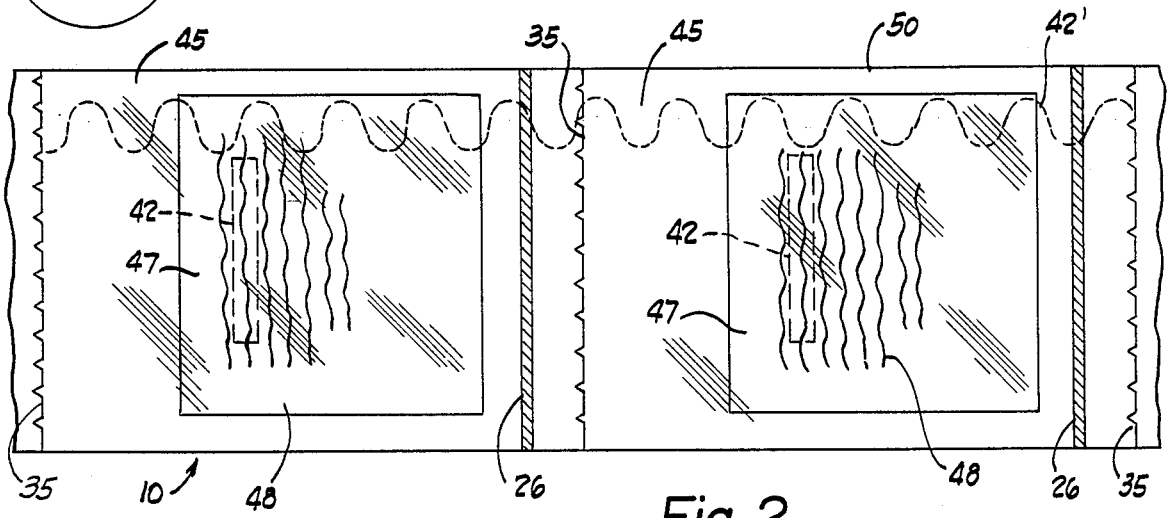
FIG. 2 shows a web produced with the FIG. 1 system including essentially invisible indicia.

After the end seals have been formed, the strip passes over a tensioning roll 27 and then to a perforating station 28. The perforating station 28 includes a roll 29. The roll 29 has a cylindrical body portion 30 having a toothed knife 32 extending from one side of the roll to the other. The knife acts against a backup roll 33 to puncture the superimposed layers of the tubular web 10. This puncturing at spaced locations provides uniformly spaced lines of weakness 35 in the form of closely spaced perforations extending from one edge of the web to the other (FIG. 2).

A perforation control detector 36 is provided at the perforation station. The perforation detector 36, like the heat seal detector 20, is connected to the control 21. Coaction of the detector 36 and this control 21 assures proper registration of the perforations.

After the web has been structurally modified to provide the seals 26 and the perforated lines 35, the web 10 passes over tensioning rolls 38, 39 and is coiled on a takeup roll 40.

When either the detector 20 or the detector 36 detects the presence of a mark or indicia 42, a signal is sent to the control mechanisms 21. The control mechanism includes circuitry which in turn sends control signals to differential speed controls (not shown) associated with the seal and perforation stations 18, 28. The circuitry of the control 21 includes a comparator which produces no output when the detector signal is below a certain threshold or reference level and produces a control voltage when the detector signal exceeds the threshold.

In FIG. 2 a section of a chain of interconnected bags formed by the apparatus of FIG. 1 is shown. Each illustrated bag 45 includes a printed area 47. The depicted printing includes wavey lines 48 which are intended to indicate either informative or decorative printing. The printed areas are shown as rectangular for clarity of illustration but in practice the amount of, and appearance of, the printing will be dictated by the user's wishes. Thus, the bag may be anything from clear to fully covered with decorative and/or informative printing, and that printing may be of any color or color combination including a color which reflects radiation of the same wave length as the electromagnetic radiation emitted by the indicia 42.

The indicia 42 are superimposed over the printing and are transparent so that their presence does not interfere with the decoration and information in the printed areas. Thus, the bags are substantially identical in appearance to otherwise identical bags which do not bear indicia 42.

The locations of the indicia are, then, selected without regard to what is printed on the web but rather with regard to proper location for controlled repeatability of work operations. This permits, as but one example of the advantages of this invention, webs of totally different physical appearance and size to be fed through the system of FIG. 1 without any setup or changes being made to the system.

The indicia 42 are seen spaced at regular intervals along the length of the web 10. In some applications the regularly spaced indicia extend across the entire width dimension of the web while in others they comprise regularly appearing spots along a certain portion of the web. Since the preferred indicia 42 are essentially invisible, they do not detract from the appearance of writing or a logo appearing on the printed area 47.

Along an edge 50 portion of the web 10 an alternative marking scheme 42' is illustrated in FIG. 2. This scheme comprises a continuous, rather than an intermittent, marking which may be used to convey a greater amount of information than the intermittent scheme. The sinusoidal like wave form may be amplitude or frequency modulated, for example, to convey a modulating signal to one of the detectors. This signal is then transmitted to the control 21 for further transmission to work stations.

The ink used for marking is comprised of a vehicle which dries clear and pigments which are normally invisible but which cause a shift in the wavelength of electromagnetic radiation in a limited, well defined, wavelength band. Tests have shown marking the web with an appropriate invisible ink to be somewhat of a problem. Typically, a web is stored in a roll on a mandrel until it is to be unwound for processing. When stored on a roll, it is necessary that the marking indicia 42 not "bleed through" or migrate among different layers of plastic thereby disrupting the well defined pattern of markings. The bleed through problem is especially pronounced when a plastic web such as low density polyethelene is utilized.

The bleed through problem has been solved when low density polyethelene comprises the web structure through utilization of wavelength shifting components which do not migrate from one layer to the next in the stored web material. One chemical useful in applying a wave shifting mark to a low density polyethelene web material is a chemical commercially available under the name Sandoz Th-40 supplied by Sandoz Colors and Chemicals Corporation. Sandoz Th-40 is a disulfonated diamino stilbene-triazine in liquid form.

To enhance the discriminating ability of the control 21 it is necessary that a concentrated amount of this chemical be applied by printing to the web material so that the mark's emission can be readily distinguished from ambient conditions. In the preferred embodiment the invisible marking material is manufactured using an ink comprising 93% varnish, 4% Sandoz Th-40 and 3% wax. The wax is commercially available from the Inmont Company under the designation 72 F9105. The varnish is a resin, alcohol mixture which in the preferred embodiment comprises 40% versamid 712 and 60% alcohol. The marking is printed to the plastic web using a suitable printing roller.

The web construction itself is described in greater detail in a concurrently filed application filed by Hershey Lerner and Harold Waitz entitled Non-Migrating Control Indicia for a Plastic Web or Sheet Article, Ser. No. 166,499 filed Jul. 7, 1980, now U.S. Pat. No. 4,467,207 issued Aug. 21, 1984. The concurrently filed application discloses several examples of suitable pigments and vehicles and is hereby expressly incorporated by reference.

Figure 3:
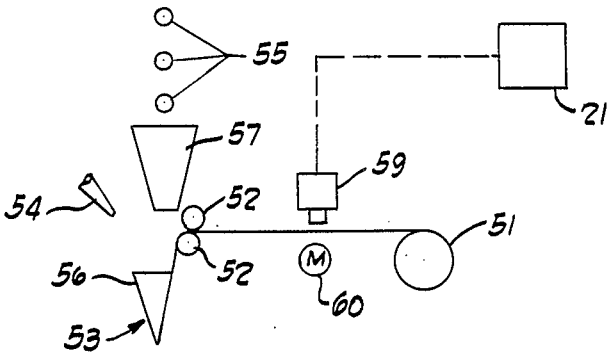
FIG. 3 diagrammatically shows a system for using the bags made with the system of FIG. 1.

FIG. 3 diagrammatically shows a bag filling machine, such as the machine described and claimed in U.S. Pat. No. 3,965,653 issued Jun. 29, 1976 under the title Packaging Method and Apparatus, equipped with a detector adapted to sense the presence of indicia 42 and thereby control web feed. In FIG. 3 a coiled web of bags 51 is provided. The web is fed between feed rolls 52 to a load station 53. A flow of air from a nozzle 54 opens a bag 56 which is to be loaded. Parts 55 are fed through a funnel 57 to fill the bag once it is registered at the load station 53.

An indicia detector is shown at 59. When the detector 59 senses an indicia a signal is sent to the control 21 which in turn controls a web feed motor 60. The control causes the motor 60 to stop driving the feed rolls 52 when the bag 56 has reached the station 53.

Figure 5:
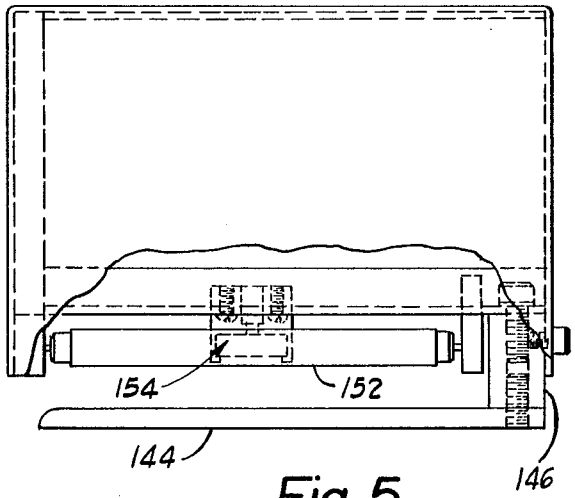
FIGS. 4 and 5 are partially sectioned elevational views of a detector for controlling fabrication or use of the web disclosed in FIG. 2 by detecting the presence of the indicias.
Figure 4:
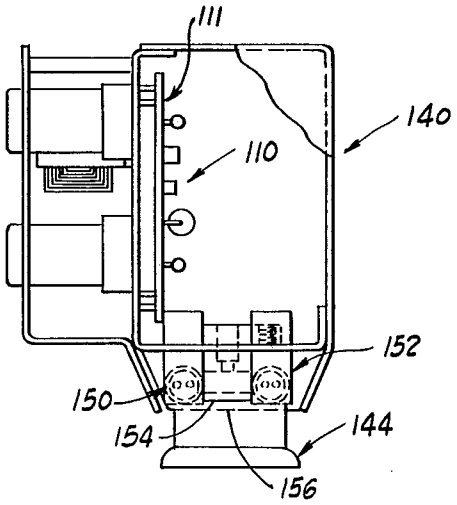
Figure 6:
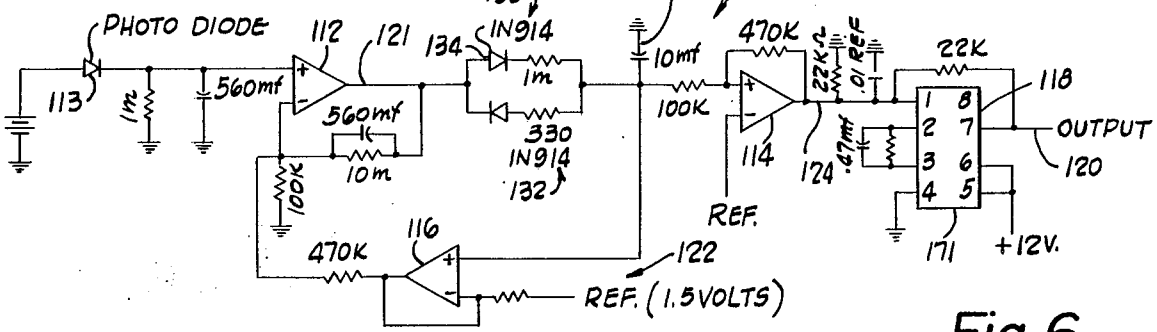
FIG. 6 shows control circuitry mounted within the detector for generating control signals in response to the detecting of the markings.

A preferred detector unit 140 for detecting the presence of markings along a web is shown in FIGS. 4–6. This unit is the preferred unit to be used as the detector 20, the detector 36, and the detector 59 used to control bag dispensing, loading and sealing operations. The unit 140 is mounted in proximity to a moving web by a detector mounting plate. A web guide 144 is positioned beneath the detector 140 and is attached to it by a suitable support 146. This guide 144 allows the web to pass beneath the detector at a distance close enough to allow the detector to sense the presence of the marking on the web. Control circuitry 110 mounted inside the unit 140 (see FIG. 3) generates control signals which allow either fabrication or manufacturing processes to be performed to the moving web.

Mounted within the detector unit are two sources of incident electromagnetic radiation 150, 152. Positioned between these sources is a detector 154 which senses the presence of markings on the web as the web passes over the web guide 144. In operation, the radiation sources 150, 152 direct indicia stimulating electromagnetic radiation of about 3660 angstroms to the web and due to their positioning concentrate a high intensity of electromagnetic radiation directly beneath the detector 154. When the incident radiation strikes the markings it causes a wave shifted output to be emitted from that marking. In the preferred embodiment Sandoz TH-40 generates an output radiation with a wavelength of about 4500 angstroms.

Interposed between the web and the detector is a filter 156, for filtering out electromagnetic radiation of wavelengths other than the wavelengths emitted by the marking. The filter enhances sensitivity by substantially preventing certain radiation reflected from the web from reaching the detector. More specifically the filter sufficiently blocks transmission of reflected indicia stimulating radiation so that such reflections will not cause false signals when indicia are not present. Reflection of electromagnetic radiation which is ambient to the machine is not a problem because its intensity, in any location occupied by humans, is not high enough to cause reflections which will cause the detector to emit false signals.

Exemplary circuitry 110 for generating control voltages in response to the presence of the web markings is shown mounted inside the detector unit 140 on a printed circuit board 111. That circuitry 110 is electrically connected to a photo diode 113 in the detector 154. Three amplifiers 112, 114, 116 and a timer 118 respond to changes in photo diode resistance with changes in electromagnetic radiation intensity to generate a control output 120.

An output 121 from a first operational amplifier 112 is coupled to a second operational amplifier 114 and further coupled to the inverting input of the first op amp 112 through a feedback network 122. The second operational amplifier 114 responds to the output 121 from the first amplifier 112. This second op amp 114 includes a reference input and a non-inverting input. When the non-inverting input signal is greater than the reference signal, an output 124 from the second operational amplifier 114 goes high. This output 124 is coupled to an industrial timer 118 which serves to shape the irregular shaped output 124 from the second amplifier 114 into a well defined signal of constant height and pulse width.

The feedback network 122 comprises two parallel connected diode, resistor circuits 130, 132 and the third amplifier 116. As the output from the first amplifier increases a diode 134 conducts through a 1 megohm resistor and charges a 10 u farad capacitor 136. As that capacitor charges its voltage increases. This voltage is coupled to a gain of one amplifier 116 and is transmitted by this amplifier 116 to the inverting input of the first amplifier 112.

If the output from the first amplifier changes slowly due to changes in the level of ambient radiation the capacitor 136 will charge slowly and the feedback input to the first amplifier'inverting input will also change slowly, trailing the non-inverting input to the first amplifier. Since the output from the first amplifier is the difference in value between its two inputs the signal transmitted to the second amplifier 114 is constant or relatively so.

A sharp, sudden rise of the output from the first amplifier 112 due to a sudden change in the current through the diode 113 causes a large signal to appear to the non-inverting input to the second amplifier 114 which triggers an output on the timer 118. The capacitor 136 cannot charge rapidly enough to significantly change the input to the third amplifier 116. The inverting input on the first amplifier does not change and therefore the difference between the two inputs remains large.

From the above it is apparent that the circuitry 110 is sensitive to rapid changes in radiation intensity and not gradual changes in ambient radiation intensity. The intensity changes necessary to actuate the output are determined by the reference input to the second amplifier 114 and can be varied according to the specific system being controlled. In the preferred and illustrated embodiment the reference input is about 1.2 volts.

The 0.047 second output from the timer 118 signifies the presence of a control mark beneath the detector 154. Since this output may not be compatible with a particular control system it may be used to generate suitable control signals which are compatible with a particular control.

Irrespective of which wavelength-shifting control indicia is used the detector arrangement remains substantially unmodified. For example, in the embodiment where IR-125 is used in the ink, the filter 156 should be a 9050 angstrom band filter. The incident radiation must be in the 7950 angstrom range and can be generated by passing incandescent radiation through a 7560 angstrom band filter or using an infrared source that radiates 7950 angstrom radiation.

While a preferred embodiment of the invention has been disclosed in detail, various modifications or alterations may be made herein without departing from the spirit or scope of the invention set forth in the appended claims.

What is claimed is:

1. A process for preparing a product for sale, shipment or the like comprising:

(a) imprinting a repetitive pattern on a plastic web to delineate a set of commodities;

(b) imprinting transparent indicia at least in part over the pattern, the indicia each including an electromagnetic wave shifting material which when stimulated by electromagnetic energy in a certain energy range emits electromagnetic energy in a different energy range;

(c) feeding the imprinted web along a workpiece path of travel at least in part illuminated by ambient illumination including electromagnetic energy in both of the certain and the different ranges;

(d) successively causing the indicia to emit energy in the different range by stimulating the indicia with energy in the certain range of an intensity greater than the energy of that portion of the ambient illumination in the certain range;

(e) successively detecting indicia emitted energy in the different range while intensity discriminating between reflected and indicia emitted energy in the different range and wavelength discriminating between stimulating and indicia emitted radiation;

(f) performing a work operation on the web in response to each such detection and at a location determined by such detection;

(g) transporting the web to a user facility;

(h) feeding the web along another path of travel;

(i) again successively causing the indicia to emit energy in the different range by stimulating the indicia with energy in the certain range of an intensity greater than the energy of that portion of the ambient illumination in the certain range;

(j) again successively detecting indicia emitted energy in the different range while intensity discriminating between reflected and indicia emitted energy in the different range and wavelength discriminating between stimulating and indicia emitted radiation; and, (k) combining a web commodity with a product after an operation at a location determined by one such again successive detection.

2. The process of claim 1 further including the step of separating a commodity from the web in response to a selected detection.

3. The process of claim 1 wherein the combining step comprises placing the product in a commodity in the form of a bag.

4. The process of claim 1 wherein the combining step comprises positioning a commodity in the form of a sleeve around a vessel.

5. A process for preparing a product for sale, shipment or the like comprising:

(a) delineating a set of commodities in a plastic web;

(b) imprinting invisible indicia at uniformly spaced locations along the web, the indicia each including an electromagnetic wave shifting material which when stimulated by electromagnetic energy in a certain energy range emits electromagnetic energy in a different energy range;

(c) feeding the web along a workpiece path of travel at least in part illuminated by ambient illumination including electromagnetic energy in both of the certain and the different ranges;

(d) successively causing the indicia to emit energy in the different range by stimulating the indicia with energy in the certain range of an intensity greater than the energy of that portion of the ambient illumination in the certain range;

(e) successively detecting indicia emitted energy in the different range while intensity discriminating between reflected and indicia emitted energy in the different range and wavelength discriminating between stimulating and indicia emitted radiation;

(f) performing a work operation on the web in response to each such detection and at a location determined by such detection;

(g) transporting the web to a user facility;

(h) feeding the web along another path of travel at least in part illuminated by ambient illumination including electromagnetic energy in both of the certain and the different ranges;

(i) again successively causing the indicia to emit energy in the different range by stimulating the indicia with energy in the certain range of an intensity greater than the energy of that portion of the another path illumination in the certain range;

(j) again successively detecting indicia emitted energy in the different range while intensity discriminating between reflected and indicia emitted energy in the different range and wavelength discriminating between stimulating and indicia emitted radiation; and, (k) combining a web commodity with a product after an operation at a location determined by one such again successive detection.

6. The process of claim 5 further including the step of separating a commodity from the web in response to a selected detection.

7. The process of claim 5 wherein the combining step comprises placing the product in a commodity in the form of a bag.

8. The process of claim 5 wherein the combining step comprises positioning a commodity in the form of a sleeve around a vessel.

9. A process for making a plastic web for use in preparing a product for sale, shipment or the like comprising:

(a) imprinting a repetitive pattern on the web to delineate a set of commodities;

(b) imprinting transparent indicia at least in part over the pattern, the indicia each including an electromagnetic wave shifting material which when stimulated by electromagnetic energy in a certain energy range emits electromagnetic energy in a different energy range;

(c) feeding the imprinted web along a workpiece path of travel at least in part illuminated by ambient illumination including electromagnetic energy in both of the certain and the different ranges;

(d) successively causing the indicia to emit energy in the different range by stimulating the indicia with energy in the certain range of an intensity greater than the energy of that portion of the ambient illumination in the certain range;

(e) successively detecting indicia emitted energy in the different range while intensity discriminating between reflected and indicia emitted energy in the different range and wavelength discriminating between stimulating and indicia emitted radiation;

(f) performing a work operation on the web in response to each such detection and at a location determined by such detection; and, (g) placing the web in condition for transportation to a user facility whereat it may be that:

(i) the web will be fed along another path of travel;

(ii) the indicia will again be successively caused to emit energy in the different range by stimulating the indicia with energy in the certain range of an intensity greater than the energy of that portion of the ambient illumination in the certain range;

(iii) indicia emitted energy in the different range will again be successively detected while intensity discriminating between reflected and indicia emitted energy in the different range and wavelength discriminating between stimulating and indicia emitted radiation; and, (iv) a web commodity will be combined with a product after an operation at a location determined by one such again successive detection.

10. The process of claim 9 wherein the work operation step is performed as the web continues to move along its path.

11. A process for making a plastic web for use in preparing a product for sale, shipment or the like comprising:

(a) delineating a set of commodities in the web;

(b) imprinting invisible indicia at uniformly spaced locations along the web, the indicia each including an electromagnetic wave shifting material which when stimulated by electromagnetic energy in a certain energy range emits electromagnetic energy in a different energy range;

(c) feeding the web along a workpiece path of travel at least in part illuminated by ambient illumination including electromagnetic energy in both of the certain and the different ranges;

(d) successively causing the indicia to emit energy in the different range by stimulating the indicia with energy in the certain range of an intensity greater than the energy of that portion of the ambient illumination in the certain range;

(e) successively detecting indicia emitted energy in the different range while intensity discriminating between reflected and indicia emitted energy in the different range and wavelength discriminating between stimulating and indicia emitted radiation;

(f) performing a work operation on the web in response to each such detection and at a location determined by such detection; and, (g) placing the web in condition for transportation to a user facility whereat it may be that:

(i) the web will be fed along another path of travel;

(ii) the indicia will again be successively caused to emit energy in the different range by stimulating the indicia with energy in the certain range of an intensity greater than the energy of that portion of the ambient illumination in the certain range;

(iii) indicia emitted energy in the different range will again be successively detected while intensity discriminating between reflected and indicia emitted energy in the different range and wavelength discriminating between stimulating and indicia emitted radiation; and, (iv) a web commodity will be combined with a product after an operation at a location determined by one such again successive detection.

12. The process of claim 11 wherein the work operation step is performed as the web continues to move along its path.

13. A process for making a web of like commodities comprising:

(a) imprinting a repetitive pattern on a plastic web;

(b) imprinting transparent indicia at least in part over the pattern, the indicia each including an electromagnetic wave shifting material which when stimulated by electromagnetic energy in a certain energy range emits electromagnetic energy in a different energy range;

(c) feeding the imprinted web along a workpiece path of travel at least in part illuminated by ambient illumination including electromagnetic energy in both of the certain and the different ranges;

(d) successively causing the indicia to emit energy in the different range by stimulating the indicia with energy in the certain range of an intensity greater than the energy of that portion of the ambient light in the certain range;

(e) successively detecting indicia emitted energy in the different range while intensity discriminating between reflected and indicia emitted energy in the different range and wavelength discriminating between stimulating and indicia emitted energy; and (f) forming a transverse seal in the web in response to each such detection and at a location determined by such detection.

14. A process for making a web of like commodities comprising:

(a) imprinting a repetitive pattern on a plastic web;

(b) imprinting transparent indicia at least in part over the pattern, the indicia each including an electromagnetic wave shifting material which when stimulated by electromagnetic energy in a certain energy range emits electromagnetic energy in a different energy range;

(c) feeding the imprinted web along a workpiece path of travel at least in part illuminated by ambient illumination including electromagnetic energy in both of the certain and the different ranges;

(d) successively causing the indicia to emit energy in the different range by stimulating the indicia with energy in the certain range of an intensity greater than the energy of that portion of the ambient light in the certain range;

(e) successively detecting indicia emitted energy in the different range while intensity discriminating between reflected and indicia emitted energy in the different range and wavelength discriminating between stimulating and indicia emitted energy; and (f) forming a transverse line of weakness in the web in response to each such detection and at a location determined by such detection.

15. A process for making a web of like commodities comprising:

(a) imprinting a repetitive pattern on a plastic web;

(b) imprinting transparent indicia at least in part over the pattern, the indicia each including an electromagnetic wave shifting material which when stimulated by electromagnetic energy in a certain energy range emits electromagnetic energy in a different energy range;

(c) feeding the imprinted web along a workpiece path of travel at least in part illuminated by ambient illumination including electromagnetic energy in both of the certain and the different ranges;

(d) successively causing the indicia to emit energy in the different range by stimulating the indicia with energy in the certain range of an intensity greater than the energy of that portion of the ambient light in the certain range;

(e) successively detecting indicia emitted energy in the different range while intensity discriminating between reflected and indicia emitted energy in the different range and wavelength discriminating between stimulating and indicia emitted energy; and (f) forming a transverse line of perforations in the web in response to each such detection and at a location determined by such detection.

* * * * *